US006938913B2

(12) United States Patent
Elkington

(10) Patent No.: US 6,938,913 B2
(45) Date of Patent: Sep. 6, 2005

(54) SNOWBOARD BINDING

(75) Inventor: Mark Elkington, Tuen Mun (HK)

(73) Assignee: Goodwell International Ltd., Tortola (VG)

( * ) Notice: Subject to any disclaimer, the term of this patent is extended or adjusted under 35 U.S.C. 154(b) by 0 days.

(21) Appl. No.: 10/705,584

(22) Filed: Nov. 10, 2003

(65) Prior Publication Data

US 2004/0113392 A1 Jun. 17, 2004

(30) Foreign Application Priority Data

Nov. 11, 2002 (DE) ..... 102 52 635

(51) Int. Cl.[7] ..... A63C 5/00
(52) U.S. Cl. ..... 280/607; 280/619; 280/633
(58) Field of Search ..... 280/14.22, 14.23, 280/619, 620, 621, 622, 623, 637, 624, 617, 616; 36/117.5, 117, 117.9, 50.5, 50.1; 24/713.4, 713.5

(56) References Cited

U.S. PATENT DOCUMENTS 4,196,530 A * 4/1980 Delery ..... 36/117.5
4,660,303 A * 4/1987 Courvoisier et al. ..... 36/117.9
4,719,670 A * 1/1988 Kurt ..... 36/117.9
4,761,859 A * 8/1988 Calabrigo ..... 36/50.5
4,949,479 A * 8/1990 Ottieri ..... 36/117.8
5,150,537 A * 9/1992 Tacchetto et al. ..... 36/117.7
5,157,813 A * 10/1992 Carroll ..... 36/50.1
5,556,123 A 9/1996 Fournier
5,687,460 A * 11/1997 Foffano et al. ..... 24/713.4
5,727,797 A 3/1998 Bowles
5,971,423 A 10/1999 Hansen et al.
6,065,770 A 5/2000 Hansen et al.
6,416,074 B1 * 7/2002 Maravetz et al. ..... 280/624

FOREIGN PATENT DOCUMENTS

DE 91 13 766 4/1992
DE 197 39 223 C2 3/1999
WO WO 00/76602 A2 12/2000

* cited by examiner

*Primary Examiner*—Hau Phan
(74) *Attorney, Agent, or Firm*—Senniger Powers

(57) ABSTRACT

A snowboard binding has a support structure with a base plate and side plates that project from the base plate. Tension cables, which hold a single instep element, are attached to the side plates. The instep element extends from a toe region of the boot up to at least its instep region. A single tensioning device for the tension cables is independent of a pivoting position of a heel element.

4 Claims, 5 Drawing Sheets

SNOWBOARD BINDING

BACKGROUND OF THE INVENTION

This invention relates generally to a snowboard binding.

Known snowboard bindings, such as the one described in WO 00/76602 A2, have a base plate screwed onto the surface of a snowboard and two side plates extending upwards from the base plate. Two straps are attached to the side plates. One strap crosses over an instep of a boot and the other crosses over a toe area, the portion of the boot that can be inserted into the binding. In this disclosure, both straps are connected to the two side plates by tension cables and can be tensioned by means of a tensioning element, which winds the tension cables onto winding spindles. This allows the effective length of the straps crossing the boot to be adjusted. The tension cables are guided over the straps twice by forming two-sided loops and the tensioning element is attached to each strap.

In DE 91 13 766 U1 and U.S. Pat. No. 5,727,797, the straps are connected to the side plates by a ratchet mechanism and toothed belts and can be tensioned by means of the ratchet mechanism.

From U.S. Pat. No. 5,556,123 and U.S. Pat. No. 5,971,423 (FIG. 13), it is known to use a single instep element that crosses over the shoe, instead of two straps. This instep element extends from the toe region to the instep region of the boot. This instep element is connected to the base plate by tension cables, which either completely cross over the instep element (U.S. Pat. No. 5,556,123) or are attached close to the side edges of the instep element (U.S. Pat. No. 5,971,423). In both documents, the tension cables are connected to a heel element (a so-called highback) that is hinged to the base plate so that it can pivot and that can be adjusted in length by suitable means such as a tensioning screw or an adjustable toothed belt. The actual tensioning of the tension cables is done by pivoting the heel element.

The adjustment of the position and thus, the effective length of the instep strap is cumbersome in practice, and either cannot be performed accurately enough or requires several adjustment steps. On the other hand, many snowboarders like to loosen the binding, i.e., the instep strap, after coming down the slope, but they still want the binding to be tight enough, e.g., for going up the slope in a chairlift, which is difficult to achieve with the known bindings described above, and then only after a very involved process.

SUMMARY OF THE INVENTION

An object of this invention is to improve the snowboard binding described above such that a simple, accurate adjustment of the effective length of the instep strap is possible.

An embodiment of the invention fixes a single instep element per boot with several, in particular at least two, tensioning cords, but nevertheless uses only a single tensioning device which is independent of the heel element. The instep element can be tensioned or loosened in one step with the single tensioning device. The configuration determined by the heel element is thus not changed.

According to one configuration of the invention, the tensioning device has one rotatable winding spindle on which the tension cables are wound. Through suitable dimensioning of the winding spindle and a turning knob connected to the spindle, a transmission ratio can be selected that enables high tensioning forces for less expenditure of force by the user. However, the tensioning device can also be a pivoting lever with several hooks in which the tension cables can be secured. Here, it is advantageous if the tension cables are then connected to each other by forming a loop, and this loop is secured in the tensioning device.

The tension cables can be any element that fulfills the requirement of capability of transferring tensile forces and of being wound up. Here, e.g., metal wires, plastic cables, tapes, and the like can be used. The tensioning device can be attached to the side plate of the base plate, to the instep element, or to the heel element.

The tensioning device has a rotatable winding spindle and a rotatable activation knob or lever. The appropriate rotational position of the winding spindle can be locked, e.g., by one or more detent pawls and a ratchet. Obviously, other known locking devices can be used, which can be fixed or locked at an arbitrary rotational position of the winding spindle by a positive fit or also a friction fit.

In the following, the invention is explained in more detail with reference to embodiments in connection with the drawing.

DETAILED DESCRIPTION OF THE PREFERRED EMBODIMENT

Figure 1:
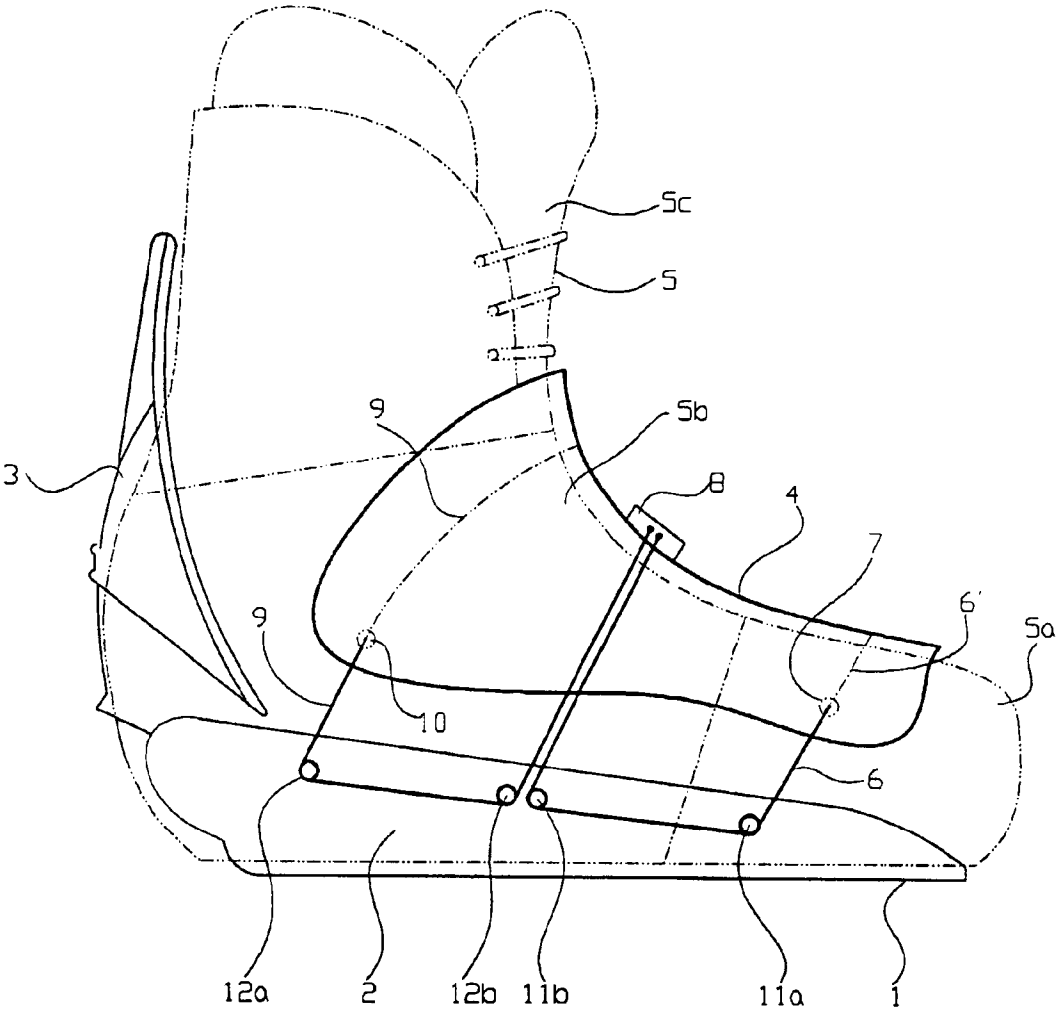
FIG. 1, a schematic side view of a snowboard binding according to a first embodiment of the invention.

At first, reference will be made to FIG. 1. A snowboard binding has a support structure with a base plate 1, which is attached in a known way to the surface of a snowboard (not shown). This is typically done with screws. Side plates 2, which extend perpendicularly from the base plate 1 and are attached to the actual base plate 1 on both sides of a boot 5, are integral components of the support structure. The side plates 2 have several functions, among other things, lateral guidance of the boot, pivotally holding a heel part 3, and holding a single instep strap 4 that extends from a front toe region 5*a* of the boot 5 to an instep region 5*b* and partially crosses over into an upper shoe region 5*c*. Although not only the instep but also the toe region and possibly also an upper shoe part are covered, here it is called an instep strap. This instep strap 4 is attached to at least one side plate 2 by tension cables 6 and 9. While numerous embodiments are possible four are described in the following. In one embodiment, the tension cable 6 is attached in the vicinity of one edge of the instep strap 4 in its toe region, which is illustrated by an attachment point 7. For example, the tension cable 6 can be riveted, sewn, screwed, inserted through an eyelet, or attached in some other known way. Then, by means of guide rollers 11*a* and 11*b* mounted on the side plate 2, the tension cable 6 is guided to a tensioning device 8, which is attached here to the instep element 4 approximately in its middle.

In a corresponding way, a second tension cable 9 is attached in the instep region 5*b* to the instep element 4 at an attachment point 10, which also lies near the edge of the instep strap. The second tension cable 9 is also guided over guide rollers 12*a* and 12*b* on the side plate 2 and likewise guided to the tensioning device 8. Thus, both tension cables 6 and 9 are tensioned by tensioning the tensioning device 8.

As indicated by the reference numbers 6' and 9' and the dashed lines, the tension cables 6 and 9 can also be guided over the instep element 4 and can reach completely over this element. On the opposite side, the ends of the tension cables 6' and 9' can either be attached rigidly to the opposing side plate or, as shown in FIG. 1 for the visible side, they can be led over corresponding guide rollers on the opposite side to the tensioning device 8, where the four ends of two tension cables then emerge.

Figure 2:
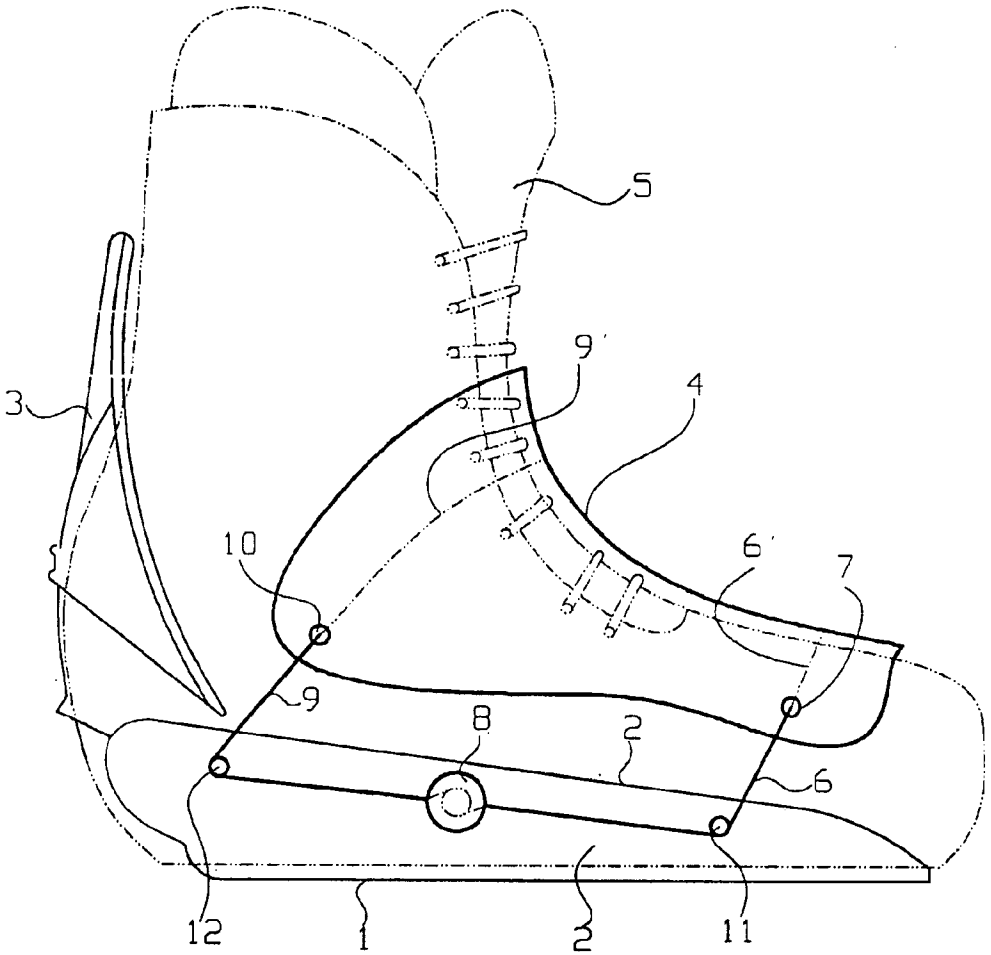
FIG. 2, a view similar to FIG. 1 according to a second embodiment of the invention.

In the embodiment of FIG. 2, a common tensioning device 8, which is attached to the side plate 2, operates similarly. Two tension cables 6 and 9 are each attached close to the side edge of the instep strap 4 at attachment points 7 and 10 and run over guide rollers 11 and 12 attached to the side plate 2 to the tensioning device 8. Here, the tension cables, as indicated by the dashed sections 6' and 9', can also completely reach the instep strap 4.

Figure 3:
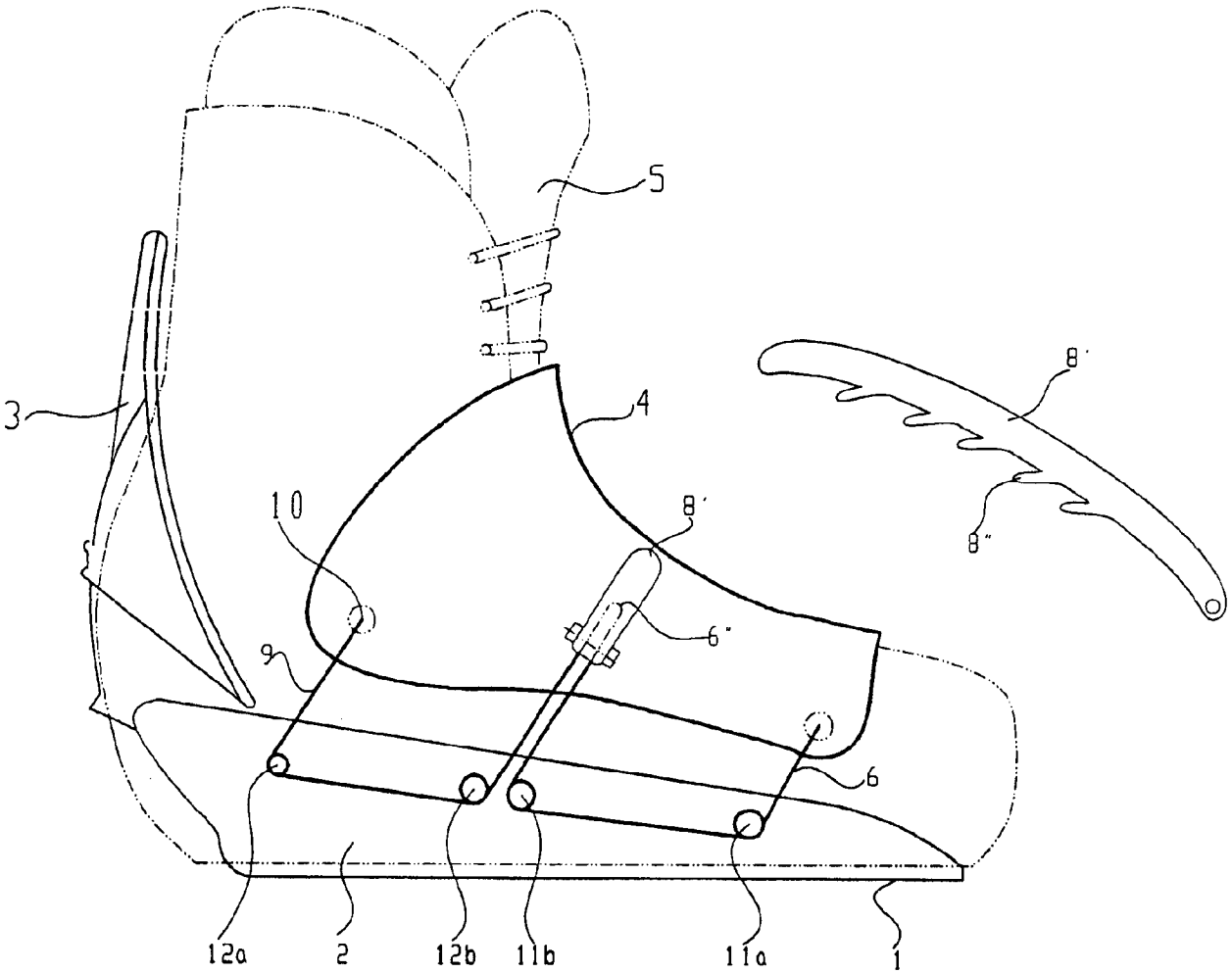
FIG. 3, a view similar to FIG. 1 according to a third embodiment of the invention.

In the embodiment of FIG. 3, a lever 8' is used as the tensioning device. This lever has several hooks 8" on its side facing the instep strap 4 in the closed position. A loop 6' of the tension cable can be secured on one of these hooks. By pivoting the lever 8', the tension cables are tensioned or loosened.

Figure 4:
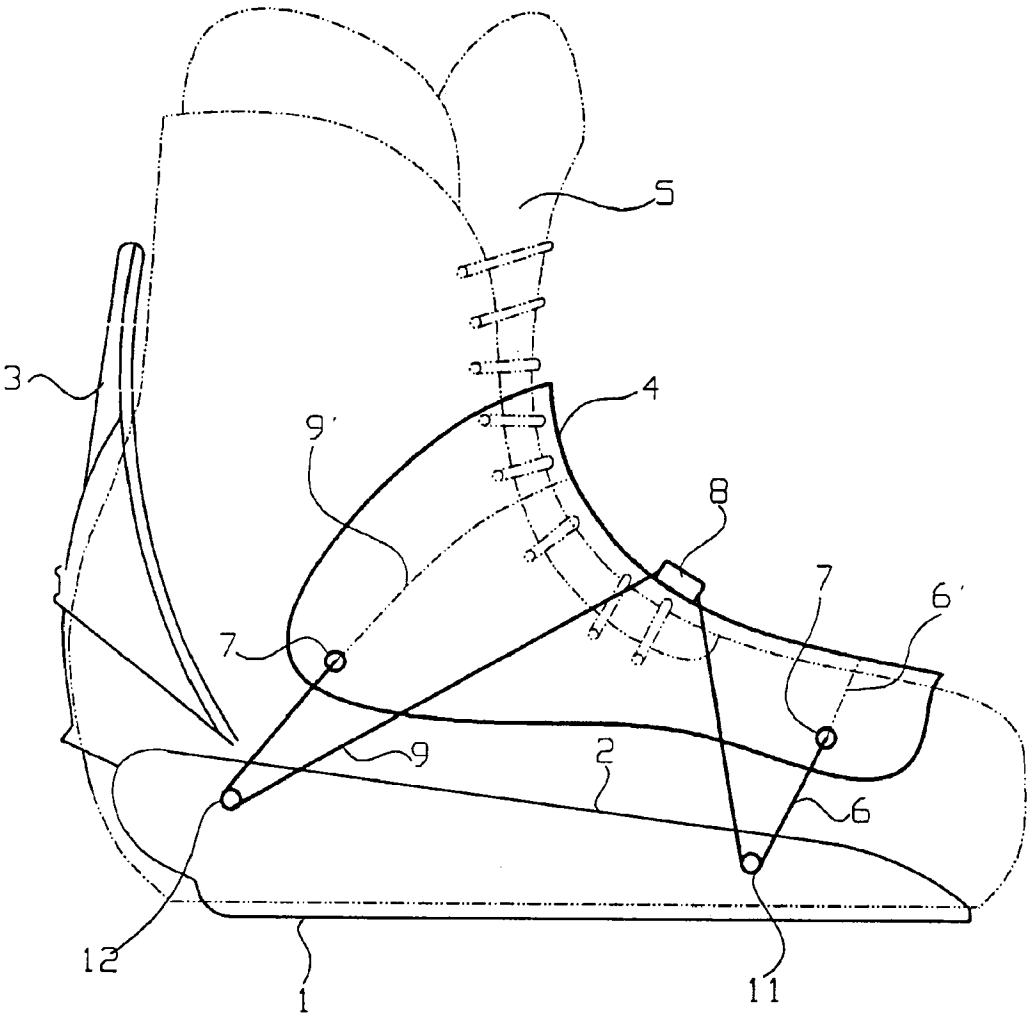
FIG. 4, a view similar to FIG. 1 according to a fourth embodiment of the invention.

For the embodiment of FIG. 4, the tension cables 6 and 9 are guided directly from the guide rollers 11 and 12 to the tensioning device 8 arranged at the center on the instep strap 4, i.e., the guide rollers 11*b* and 12*b* of FIG. 1 are eliminated. Otherwise, this embodiment corresponds to that of FIG. 1.

Figure 5:
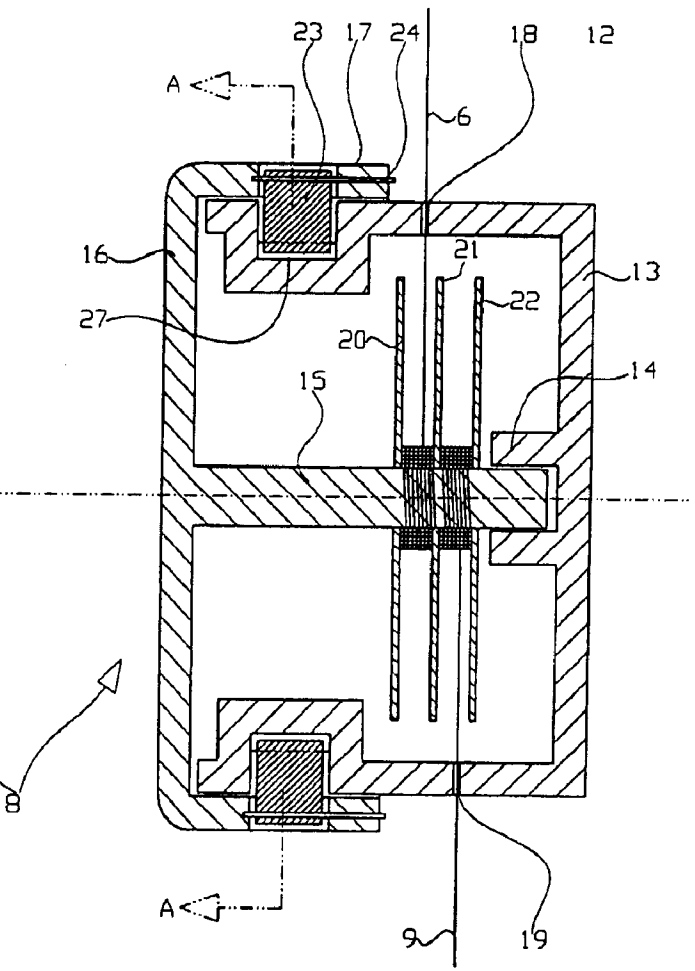
FIG. 5, a cross section of an embodiment of a tensioning device.

The tensioning device of FIG. 5 has a pot-shaped housing 12 with an essentially flat base 13 that is attached to the binding, thus, in particular, to the side plate 2 or the instep strap 4. The housing 12 has a cylindrical projection 14, which extends inwards and acts as a guide or support for a winding spindle 15 that is integrally connected to a housing cover 16 which surrounds the housing 12 with an annular region 17 and which is also guided and supported there. Here, the housing 12 has two openings 18 and 19, through which tension cables 6 and 9 are guided into the interior of the housing and can be wound on the winding spindle 15. The appropriate ends of the tension cables 6 and 9 are attached to the winding spindle 15. Guidance disks 20, 21, 22 can be amended on the winding spindle 15 which are used for controlled winding of the tension cables 6 and 9 when the winding spindle 15 is turned.

A detent pawl 23 is mounted on the cover 16 so that it can pivot by means of a pin 24, the detent pawl being pressed inwards in the radial direction by a spring 25, here a leaf spring, at the end that has a catch 26. The housing 13 has a recess 27 that corresponds to the width of the detent pawl 23 and in which a ratchet 28 is mounted. The catch 26 is secured in this ratchet 28, so that an engagement is realized in such a way that the cover 27 can be turned in only one direction of rotation, namely the tensioning direction, for an active detent pawl.

To loosen, the detent pawl 23 is pivoted against the force of the spring 25 about the axis 24 until the catch 26 disengages from the ratchet 28. To enable this pivoting, the cover 17 has a groove 29 in the region of the detent pawl 23. The rear end of the detent pawl 23 is accessible from outside through this groove, and the detent pawl can be pivoted in the described way.

Figure 6:
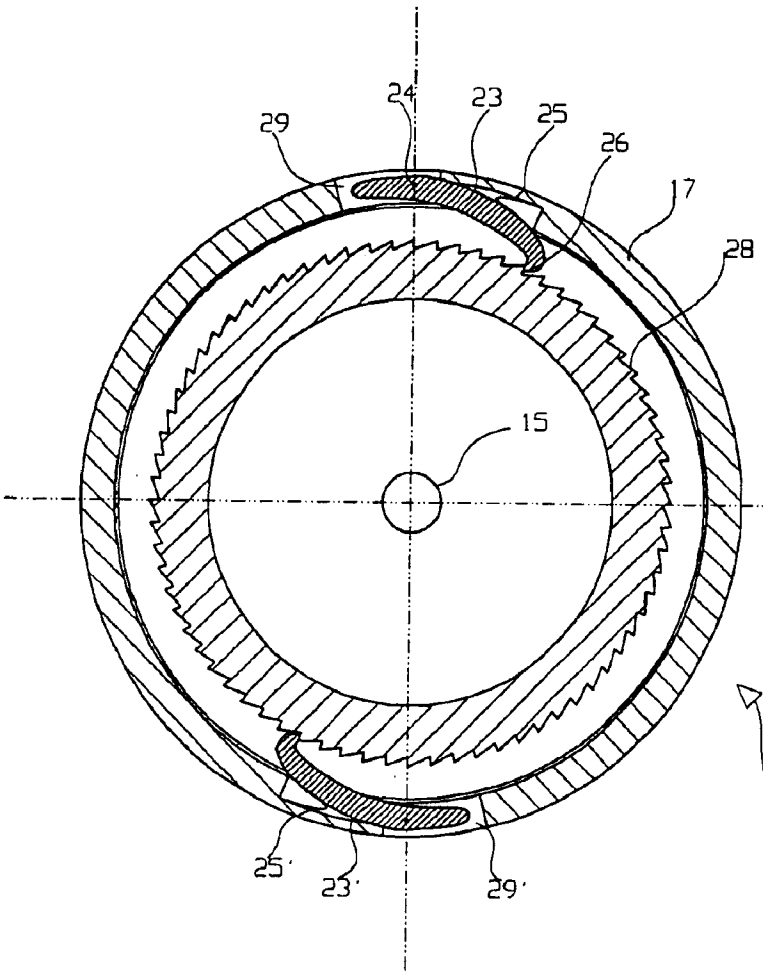
FIG. 6, a section along the line A—A of FIG. 5.

In the embodiment of FIG. 6, two opposing catches 26 are shown with the corresponding parts of the second catch being designated with a stroke.

Obviously, other constructions of tensioning devices that wind a tension cable can also be used. If higher tensioning forces are to be applied, then gear reduction can also be realized using gears.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A snowboard binding for fastening a boot to a snowboard comprising:

a support structure, a heel element attached to the support structure, an instep element attached to the support structure for at least partially covering a top side of the boot, tension cables for attaching the instep element to the support structure, and a tensioning device for tightening and loosening the tension cables;

said instep element being sized and shaped for extending at least from a toe region of the boot to an instep region of the boot, the instep element being attached in the toe region and in the instep region to the support structure by the tension cables, said tensioning device being attached to the support structure independent of the heel element, said tensioning device having a rotatable winding spindle on which the tension cables can be wound and a locking device for locking the winding spindle, said locking device being a pivoting lever with several hooks on which a loop of the tension cables can be secured.

2. A snowboard binding as set forth in claim 1 wherein the tension cables are attached to one wide edge of the instep element.

3. A snowboard binding for fastening a boot to a snowboard comprising:

a support structure, a heel element attached to the support structure, an instep element attached to the support structure for at least partially covering a top side of the boot, tension cables for attaching the instep element to the support structure, and a tensioning device for tightening and loosening the tension cables;

said instep element being sized and shaped for extending at least from a toe region of the boot to an instep region of the boot, the instep element being attached in the toe region and in the instep region to the support structure by the tension cables;

said tensioning device being attached on the instep element independent of the heel element;

said tensioning device having a rotatable winding spindle on which the tension cable can be wound and a locking device for looking the winding spindle;

said locking device being a pivoting lever with several hooks on which a loop of the tension cables can be secured.

4. A snowboard binding as set forth in claim 3 wherein the tension cables is attached to one side edge of the instep element.

* * * * *

UNITED STATES PATENT AND TRADEMARK OFFICE

CERTIFICATE OF CORRECTION

PATENT NO. : 6,938,913 B2
DATED : September 6, 2005
INVENTOR(S) : Elkington

It is certified that error appears in the above-identified patent and that said Letters Patent is hereby corrected as shown below:

Column 4,
Line 38, “wide” should read -- side --.

Signed and Sealed this

Sixth Day of December, 2005

JON W. DUDAS
*Director of the United States Patent and Trademark Office*